United States Patent [19]

Braun et al.

[11] 4,216,824

[45] Aug. 12, 1980

[54] SPACER FOR REMOVABLE HEAT EXCHANGER TUBES

[75] Inventors: Richard R. Braun; Glen E. Petaja; Charles E. Cedar, all of Hibbing, Minn.

[73] Assignee: L & M Radiator, Inc., Hibbing, Minn.

[21] Appl. No.: 20,828

[22] Filed: Mar. 16, 1979

[51] Int. Cl.[2] ..... F28F 9/00

[52] U.S. Cl. ..... 165/69; 165/153

[58] Field of Search ..... 165/69, 172, 152, 153, 165/76, 149

[56] References Cited

U.S. PATENT DOCUMENTS

| | | | |
|---|---|---|---|
| 1,831,533 | 11/1931 | Hubbard | 165/76 |
| 2,927,781 | 3/1960 | Fohrhaltz et al. | 165/69 |
| 3,924,676 | 12/1975 | Bennett | 165/172 |
| 4,007,773 | 2/1977 | McCormick | 165/69 |

FOREIGN PATENT DOCUMENTS

| | | | |
|---|---|---|---|
| 2410670 | 11/1975 | Fed. Rep. of Germany | 165/172 |

*Primary Examiner*—Sheldon Richter

*Attorney, Agent, or Firm*—Allegretti, Newitt, Witcoff & McAndrews

[57] ABSTRACT

The invention relates to spacers for the individual units of a heat exchanger assembly containing a plurality of tubes with cooling fins secured thereto. The specifically shaped, readily removable and usable spacers are positioned in the heat exchanger assembly between fins of adjacent fin and tube assemblies and between fins of each individual fin and tube assembly particularly in situations where the tubes are quite long, i.e., about two feet or more in length. The spacers are formed of blocks of substantially solid somewhat resilient material, preferably an elastomeric heat and fluid resistant material. The spacers may have opposed stop flanges or wings formed thereon to provide a finished product which as a cross or crucifix-type cross section.

3 Claims, 8 Drawing Figures

Fig. 1
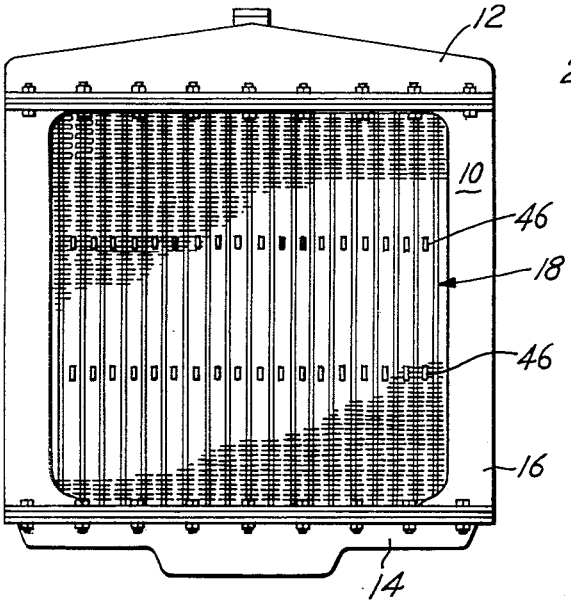
Fig. 2
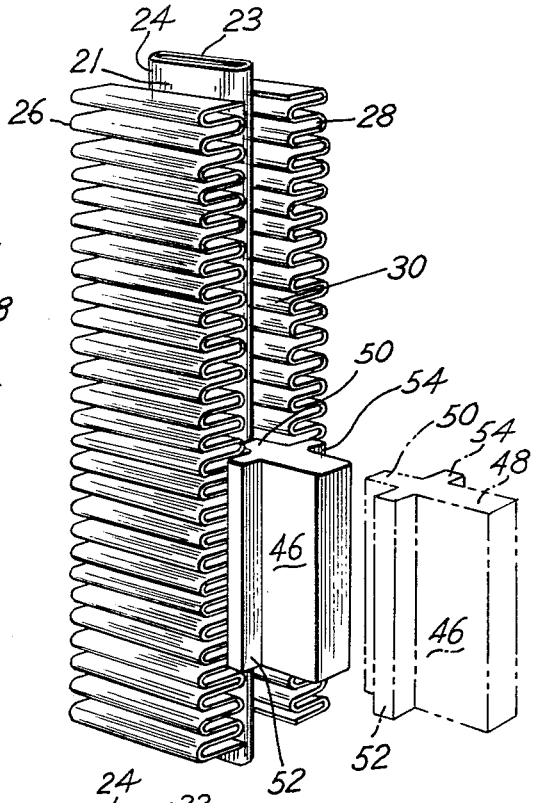
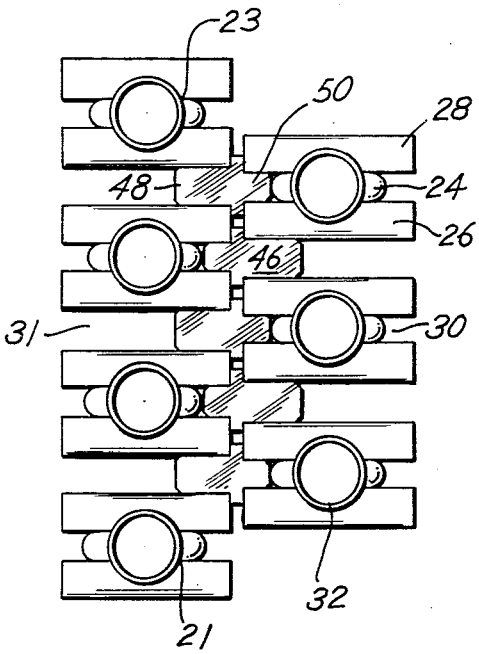
Fig. 3
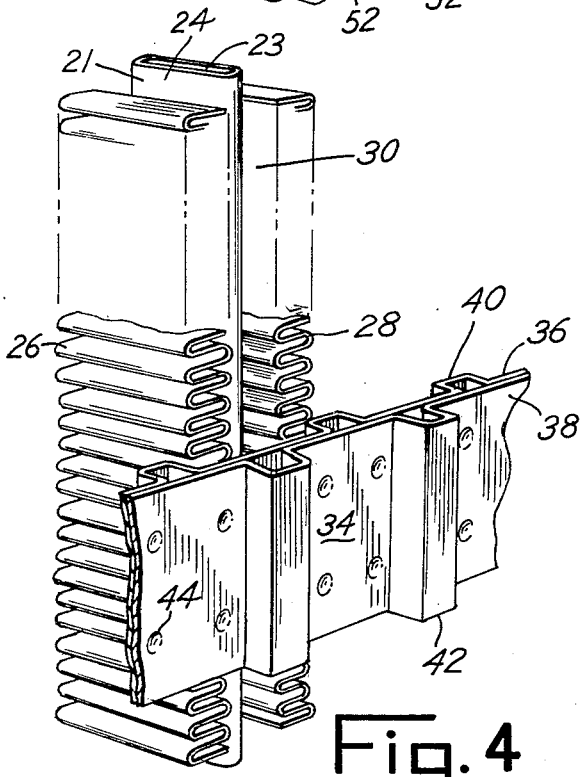
Fig. 4
(PRIOR ART)

Fig. 5
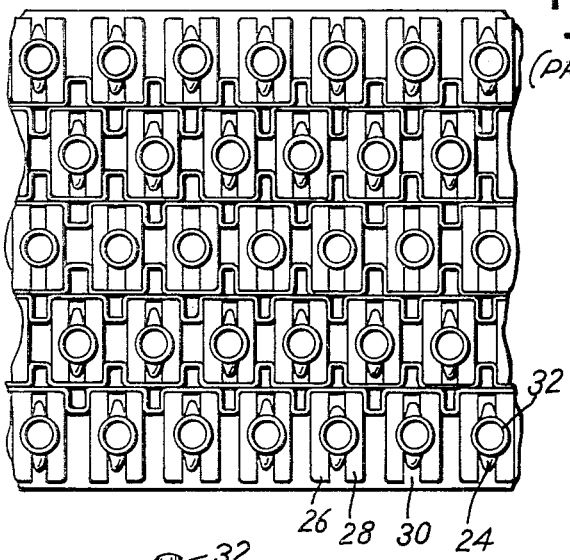
Fig. 6
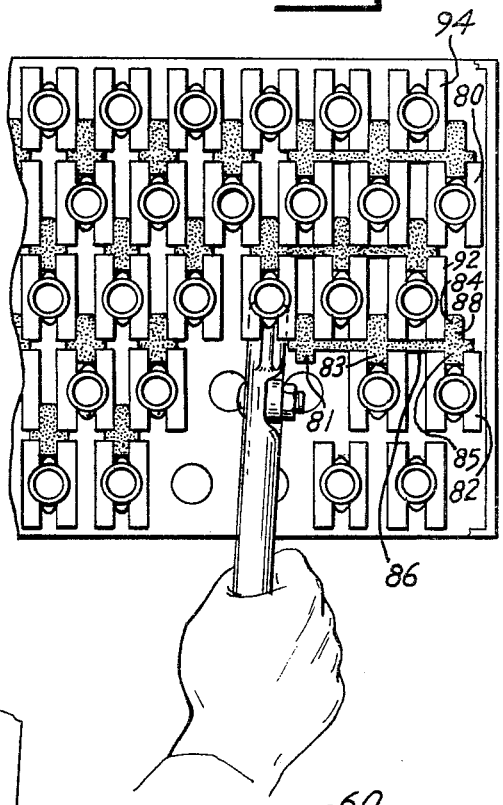
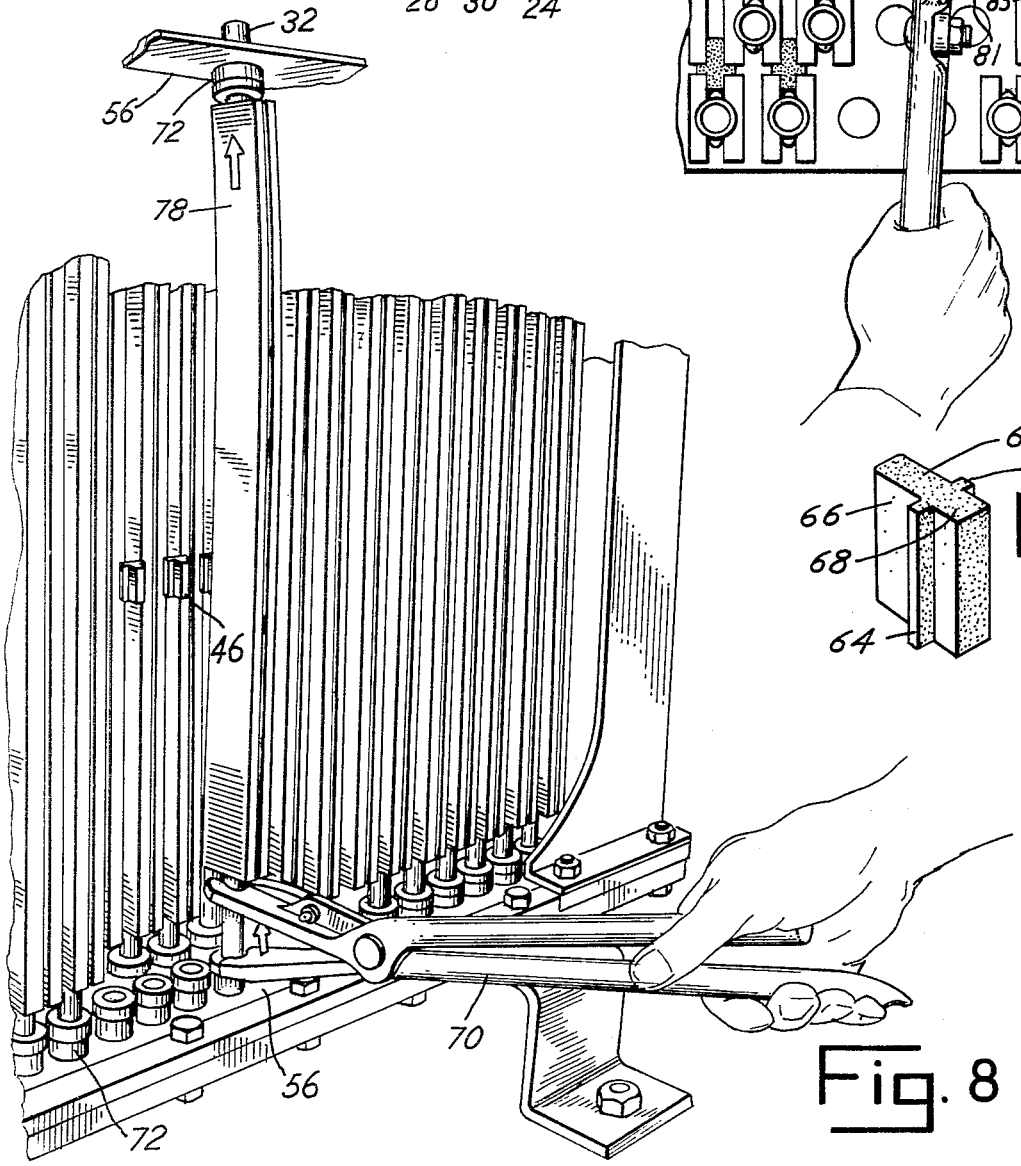
Fig. 7
Fig. 8

SPACER FOR REMOVABLE HEAT EXCHANGER TUBES

BACKGROUND OF THE INVENTION

As shown in FIGS. 4 and 5, prior art fin and tube assemblies comprise a very long tube, two feet or more in length, generally flattened to an eliptically shape with fins attached to each side of the eliptically shaped tubes to form channels between the fins of each tube. The prior art practice was to connect strips of metal as shown in FIGS. 4 and 5 across the entire width of the horizontal dimension of the radiator. Depending on the size of the radiator, two or more strips of metal were necessarily utilized to hold the tube and fin assemblies in position. These strips were usually formed by welding together two strips of metal which had been previously bent to form a plurality of spaced U-shaped vertically extending channels. The U-shaped channels of the strips were inserted between each separate fin and tube assembly and were secured to the frame of the radiator by suitable fastening means such as screws or nuts and bolts. These metal strips not only obstructed the flow of cooling fluid, i.e., air, over the radiator fins and tubes but also made it necessary to remove an entire horizontal array of fins and tubes to replace an interior located damage fin and tube assembly which, as stated, might be positioned in back of one or more rows of fin and tube assemblies. Furthermore, the metal strips are costly to fabricate and tend to physically damage the tubes and fins because of vibration. In addition, under certain conditions, the strips would cause electrolytic corrosion between the tubes, which are generally formed of copper, and the strip, which were usually formed of steel. Assembling the heat exchanger by utilizing the metal strips was also costly and time consuming.

SUMMARY OF THE INVENTION

Individual relatively small spacing blocks, preferably of generally cross-shaped, cross sectional configuration, are utilized to retain fin and tube assemblies of radiators or heat exchanger units in proper position along their length. These small blocks can be arranged so that obstruction of cooling fluid is minimized and damaged fin and tube assemblies in the interior of the units are easily accessible for repair or replacement without a major portion of the entire unit to be disassembled.

BRIEF DESCRIPTION OF THE DRAWINGS

FIG. 1 is a front elevational view of a radiator or heat exchanger of the type to which the invention may be applied;

FIG. 2 is a perspective view of a portion of one fin and tube assembly with the preferred spacer block shown in solid lines in position between the fins of one tube. A perspective view of one preferred complete block or spacer is shown in dotted outline;

FIG. 3 is a partial, vertical, sectional view of a specific assembly of a plurality of fin and tube assemblies with the spacers positioned therebetween in a typical manner contemplated by this invention;

FIG. 4 is a perspective view of a single fin and tube assembly with the prior art metal strip shown in its assembled position;

FIG. 5 is a partial vertical sectional view of a heat exchanger utilizing the prior art metal strip retainers taken just above one set of retaining strips;

FIG. 6 is a partial horizontal sectional view of a typical heat exchanger separated by the blocks of the present invention taken just above one set of spacers;

FIG. 7 is a perspective view of a slightly different shaped spacer from that shown in FIG. 2; and FIG. 8 is a partial view of a single fin and tube assembly being removed from a heat exchanger utilizing the spacers described herein.

DESCRIPTION OF THE PREFERRED EMBODIMENT

FIG. 1 illustrates a typical radiator or heat exchanger 10 which includes an upper header 12 and a lower header 14, each of which are secured to vertical frames 16. The heat exchanger comprises a plurality of vertically disposed fin and tube assemblies 18 to which a fluid to be cooled is supplied in a conventional manner to upper header 12. The fluid passes from header 12 through tube assemblies 18 and is discharged into lower header 14 for recovery and recycle back to the engine.

The fin and tube assemblies 18 comprise a tube or conduit 24 which is preferably eliptical in shape. A plurality of convoluted fins 26 and 28 are secured to the opposite flat sides 21 and 23 of the conduit 24 by a suitable method, such as welding, soldering or brazing although other types of fins and methods of attachment may be utilized. The convoluted fins 26 and 28 are, therefore, spaced from each other to form a vertical channel 30. The ends 32 of the conduits 24 may be rounded as shown in FIGS. 3 and 8. Typically, the entire conduit may be round originally and is subsequently flattened between its round ends in a manner well known in the art prior to the fins being attached to the flattened portions. The degree of flattening obtained and the exact portion of the fins in the tubes can vary the width of the vertical channel 30 and may require a change in the configuration of the spacers, as will be described hereinafter.

As shown in FIGS. 4 and 5, the fin and tube assemblies 24, 26 and 28 which are to be placed in the radiator 10 in vertical alignment with other such assemblies, were previously aligned through the use of a metal spacing device 34 which included two strips of metal 36 and 38, usually formed of sheet steel and welded together at 44 to provide U-shaped channels 40, 42 on opposite sides of the spacer 34. The fin and tube assembly 18 was inserted between adjacent channels 40, 42 on opposite sides of the assembly 34. In a large radiator, two or more sets of strips were spaced vertically from each other across the assembly.

Referring to FIGS. 2, 3, 6 and 8, the assembly 34 is eliminated in its entirety and, instead, a plurality of blocks generally indicated at 46 are substituted. In a large radiator such as shown in FIG. 1, at least two parallel horizontal rows of blocks 46 are utilized. Each block 46 preferably consists of a slightly deformable material such as plastic, elastomeric or rubber-like material having high resistance to temperature and the fluids to be contacted in a specific application. Any so-called elastomer having these properties, natural or synthetic, may be utilized. Polyurethane elastomers are particularly preferred. Similarly, it is possible to use wooden blocks since they usually are sufficiently resilient so as to be capable of being placed in contact with the fin and tube assemblies without damage thereto. Wood, however, is not generally preferred because of the inherent tendency of wood to lose its resiliency and thus fall out of place.

As shown in FIG. 2, the individual blocks 46 are preferably formed to provide a generally cross or crucifix shaped cross section having a body portion 48 which may have different dimensions than the other body portion 50 when viewed in a vertical direction depending on the tube and core spacing and configuration. In addition, vertically extending integral stop flanges or projections 52 and 54 may be provided in alignment horizontally on opposite sides of the block 48, 50 to help maintain the block in position. Similarly, these flanges help separate the tube assemblies and provide spacing between the parallel rows, thereby preventing damage to the conduits and ensuring effective heat exchange.

In the specific embodiment illustrated, the portion 50 of less width is inserted within channel 30 formed by adjacent sections 26 and 28 of the heat exchanger fins. The portion 48 having the greater width is inserted in space 31 between adjacent fins of adjacent assemblies 18. Because the blocks 46 are slightly deformable due to their elastomeric properties, the blocks will be tightly retained by the tube assembly within the channel 30.

Referring to FIGS. 3 and 6, it will be noted that the thicker portion 48 of the block 46 extends between offset rows of fin and tube assemblies 24, 26, 28 and because of the physical properties of the blocks, are retained securely in place since the width of the portion 48 of the blocks sized to be maintained within the spacing between the adjacent fins of adjacent fin and tube assemblies. The fin and tube assemblies 24, 26, 28 are secured to headers 56 at the tops and bottoms of the conduits 24 and, as stated, the tubes have rounded exteriors for insertion into the headers and retained thereon by suitable rubber grommets which is in a manner well known in the art.

Also illustrated in FIG. 6 is a preferred method of positioning and installing the spacer blocks near the sides of the radiator to support the extreme, outermost fin and tube assemblies. In this embodiment, multiple interconnected spacer blocks 84 comprising individual blocks 81, 83 and 85 interconnected by a continuous projection or flanges 86 are utilized to separate extreme end fin and tube assemblies 80 and 92 from tube assemblies 92, 94, etc. If a single spacer 84, were positioned within the channel of assembly 80, this single spacer, because of its partially supported position could vibrate loose and fall out. By securing the spacer, however, to an internally positioned completely supported spacer 81, 83, this problem is alleviated. The end spacer remains in position because of its connection to the more securely positioned spacers 81 and 83 thus supporting fin and tube assemblies 80 and 92 and preventing contact between assemblies 80 and 82 and assemblies 92 and 94, respectively.

It will be obvious that the blocks 46 prevent excessive movement or vibration of the fin and tube assemblies and retain these assemblies in their proper position with adjacent (both aligned and offset) rows so that cooling fluid passes freely over and through the assemblies. It will also be apparent from FIG. 6 that a specific fin and tube assemblies which may require replacement but which is interiorly positioned within the radiator assembly may be readily replaced by removing only a few of the fin and tube assemblies in front of which may be accomplished by forcing the tubes out of the grommets and headers in a manner well known in the art and then removing only the necessary number of blocks 46 until the tube to be replaced is accessible. This can be accomplished manually by a simple tool shown in FIG. 6, which may also be used for wedging the blocks into their assembled position. Thereafter the radiator may be re-assembled by placing the fin and tube assemblies in the header grommets and replacing the blocks 46 in their proper original position. In other words, an entire exterior row of fin and tube assemblies would not be removed to have access to and repair an interior fin and tube assembly.

From the foregoing, it will be apparent that an improved construction has been provided for large radiators or heat exchangers which overcomes the former problems of wear and leakage caused by vibrations or electrolytic corrosion, which construction is less expensive and easier to assemble and disassemble than the prior art construction.

Referring to FIG. 7, a similar spacer block is shown at 60 with stop flanges or projections 66 and 68 extending from body portions of 62 and 64 which are of the same width. If the conduits 24 are constructed and positioned within the radiator so that the space 30 between the fins 26 and 28 in FIG. 3, for example, is the same as the space 31 between adjacent assemblies, block 60 would be used. Similarly, in certain embodiments, the spaces could merely be simple blocks of rectangular shape. The addition of stop flanges are, however, preferred.

FIG. 8 is a perspective view showing manual removal of a single fin and tube assembly by use of a hand tool 70 and also shows sealing grommets 72 in the headers 56. This illustrates how only a few fin and tube assemblies 18 need to be removed to repair a tube in the interior of the heat exchanger assembly. Furthermore, the advantages of being able to remove and replace a simple damaged fin and tube assembly which may be in the middle of the radiator is readily possible without disassembling large portions of the radiator case.

While certain embodiments of the invention have been illustrated and described, it is to be understood that it is capable of other modifications. Changes, therefore, may be made in construction and arrangement without departing from the spirit and scope of the invention as defined in the appended claims.

What is claimed is:

1. In a heat exchanger having a plurality of individual heat exchange units adapted to cool a fluid passing therethrough, said individual units each comprising an assembly including a plurality of elongated conduits, each conduit having a pair of finned surfaces attached thereto to serve as heat exchanger surfaces with at least some of the conduits being positioned in parallel relation to each other and said finned surfaces extending a substantial distance along at least two sides of the conduits to form at least two parallel channels at opposite sides of said conduits said conduits being spaced apart to provide parallel spaces between adjacent individual heat exchange units, the improved heat exchanger assembly which comprises (a) a block of temperature and fluid resistant elastomeric material, one end placed into at least one of said channels and the other end placed in said spaces, said block having a thickness in the dimension to be inserted into said channels and spaces so as to be retained in the channel;

(b) a flange formed on at least one side of the block and extending outwardly of the portion thereof which is inserted in said channels and spaces.

2. The improved heat exchange assembly of claim 1 wherein a plurality of said blocks are interconnected by said flanges, said interconnected blocks positioned near the ends of the heat exchange assembly.

3. The improved heat exchange assembly of claim 1 wherein the spacing between the fins of one set of assemblies is greater than the space in said channels, said block having two portions of different thickness on either side of said flanges to accommodate the differences in spacing.

* * * * *